US006533896B1

(12) United States Patent
Tikka et al.

(10) Patent No.: US 6,533,896 B1
(45) Date of Patent: Mar. 18, 2003

(54) METHOD FOR THE PRODUCTION OF PRECLEANED PULP

(75) Inventors: Panu Tikka, Rauma (FI); Mikael Svedman, Rauma (FI); Thomas Fant, Böle (FI)

(73) Assignee: Metso Chemical Pulping Oy (FI)

( * ) Notice: Subject to any disclaimer, the term of this patent is extended or adjusted under 35 U.S.C. 154(b) by 0 days.

(21) Appl. No.: 09/589,706

(22) Filed: Jun. 8, 2000

Related U.S. Application Data

(63) Continuation of application No. 09/167,423, filed on Oct. 6, 1998, now abandoned.

(30) Foreign Application Priority Data

Dec. 8, 1997 (FI) ..... 974455

(51) Int. Cl.[7] ..... D21C 3/04; D21C 3/06; D21C 3/26; D21C 9/02

(52) U.S. Cl. ..... 162/19; 162/60; 162/68; 162/76; 162/82; 162/90

(58) Field of Search ..... 162/19, 60, 65, 162/76, 82, 90, 68

(56) References Cited

U.S. PATENT DOCUMENTS

| | | | | |
|---|---|---|---|---|
| 3,923,591 A | | 12/1975 | Villavicencio | 162/86 |
| 4,050,981 A | * | 9/1977 | Jamieson et al. | 162/60 |
| 4,087,318 A | | 5/1978 | Samuelson et al. | 162/60 |
| 4,198,266 A | | 4/1980 | Kirk et al. | 162/65 |
| 4,436,586 A | | 3/1984 | Elmore | 162/19 |
| 4,826,567 A | | 5/1989 | Gratzl | 162/72 |
| 4,826,568 A | | 5/1989 | Gratzl | 162/76 |
| 5,424,417 A | * | 6/1995 | Torget et al. | 162/19 |
| 5,589,033 A | | 12/1996 | Tikka et al. | 162/84 |
| 5,593,544 A | | 1/1997 | Fahlgren et al. | 162/65 |

FOREIGN PATENT DOCUMENTS

| | | | | |
|---|---|---|---|---|
| WO | 96/12063 | * | 4/1996 | 162/65 |

OTHER PUBLICATIONS

Sven A. Rydholm, "Pulping Processes," Interscience Publishers, 1965, pp. 648–673.

Sven A. Rydholm, "Pulping Processes," Interscience Publishers, 1967, pp. 583 and 584.

Vuorinen et al., "Selective Hydrolysis of Hexenuronic Acid Groups and its Applicatoin in ECF and TCF Bleaching of Kraft Pulps," 1996 International Pulp Bleaching Conference, pp. 43–51.

* cited by examiner

*Primary Examiner*—Steve Alvo
(74) *Attorney, Agent, or Firm*—Lerner, David, Littenberg, Krumholz & Mentlik, LLP

(57) ABSTRACT

A method for preparing pulp from lignin-containing cellulosic material is disclosed, including a step for acid cleaning of the lignocellulosic material, followed by alkaline delignification. The acidic step removes undesired components such as metal ions and side groups of polysaccharides, which may have adverse effects on the process especially when extensive recycling of liquors is employed within the plant.

18 Claims, 4 Drawing Sheets

METHOD FOR THE PRODUCTION OF PRECLEANED PULP

CROSS REFERENCE TO RELATED APPLICATIONS

This application is a continuation of U.S. Ser. No. 09/167,423 filed Oct. 6, 1998, now abandoned, which also claims the priority of Finland 974455 filed Dec. 8, 1997.

FIELD OF THE INVENTION

The present invention relates to a process for the production of purified pulp from lignocellulose-containing material. More particularly, the present invention relates to the production of pulp which has been purified in terms of removing harmful non-process compounds by an acidic pre-cleaning stage prior to delignification by alkaline cooking. Still more particularly, the present invention relates to a process for the production of a pulp to be bleached for papermaking pulp.

BACKGROUND OF THE INVENTION

Throughout this disclosure, the term "alkaline cooking" refers to pulp manufacturing processes well known in the art as kraft cooking, soda cooking and soda anthraquinone cooking.

All lignin-containing cellulosic materials in nature contain a wide variety of organic and inorganic compounds beside the main process compounds, lignin and cellulose. Unavoidably these non-process compounds enter the pulping process and will be subjected to the same chemical and physical treatment as the desired compounds. This is especially true in the case of alkaline delignification processes, such as kraft and soda cooking, which do not remove for example metal ions from the processed material. Traditionally, these non-process compounds have been led to the combustion and recovery line of the pulp mill with the spent liquor, or they have been ousted together with pulp mill effluents. Only some compounds have been separated and sold as by-products, such as sugars, tall oil and turpentine. Under the conventional circumstances of distribution of these compounds in a pulp mill process system, conventional pulping technology has been able to cope with the arising problems, such as foaming, deposits, higher consumption of bleaching chemicals, heavy metal chelating, just to mention a few from the huge list of routine difficulties in the operation.

Metals entering the process include all those occurring naturally in raw materials; monovalent metals sodium and potassium, earth-alkali divalent metals calcium, magnesium and barium, and heavy metals such as iron, copper and manganese. Under alkaline conditions metal ions are retained in the pulp and cause a lot of harm in terms of making the bleaching by oxygen chemicals, especially by hydrogen peroxide, less effective resulting in deteriorated pulp strength and excess chemical consumption. In addition divalent metals, especially calcium, tend to form precipitated deposits in process machinery, thus compromising operational efficiency. Currently, the metal problem is coped with by washing the metals to effluents after an acidic bleaching stage, or chelating metals in separate so called Q stages before peroxide bleaching stages. Once the metals are in the pulp mill cycle, they are difficult to remove. In practice the concentrations will increase to reach an equilibrium between dissolution and precipitation, and some precipitates become removed in the filtration of cooking liquors. It is quite clear that any process for removal of metals prior to their entering the pulp mill cycle would greatly improve the situation.

The side-groups in polysaccharides represent another group of non-process compounds. These side groups are not desired in the pulp product and their presence in the delignifying and bleaching processes is negative. It has been known for a long time that the acetyl groups of hemicelluloses are easily cleaved, but they consume alkali. Could they be removed prior to alkaline cooking, a lot of alkali could be saved for delignification. Another example is the formation of so-called hexenuronic acid groups from hemicellulose side-groups in alkaline cooking (Vuorinen et al., Selective hydrolysis of hexenuronic acid groups and its application in ECF and TCF bleaching of kraft pulps. International Pulp Bleaching Conference, Apr. 14–18, 1996, Washington D.C.). Downstream in the process, these groups are responsible for part of the bleaching chemical consumption and cause pulp brightness problems. Could they be removed prior to the alkaline cooking, the problem would be solved without any need for measures in the following process steps. In brief, the non-process compounds described above have negative effects in alkaline pulping. Metal ions are not removed due to the high pH, and polysaccharide side groups increase alkali consumption and react to form harmful compounds in the pulp. It does not make sense to introduce any unnecessary compounds into the alkaline cooking process; only the backbone polysaccharides are desired for the cellulosic pulp after delignification in cooking and bleaching.

As said above, under conventional conditions of non-process compound distribution in a pulp mill process system, the problems caused by these agents have been overcome by means of conventional pulping technology. However, contemporary pulping is developing in a very demanding direction: towards a closed-cycle pulp mill. Ultimately this means no effluents at all: the mill will recycle its own process water, which flows counter-currently to the pulping process. On the way towards zero-effluent pulp mill by reducing the wastewater amount, the industry has faced severe problems caused by the accumulation of non-process compounds in the processes. Various process internal measures and technologies have been proposed and applied to cope with undesired accumulating agents. Typical for all of these measures is that they are applied process-internally, i.e. in the middle of the fiber line, after the non-process compounds have entered the more or less closed process. It is quite obvious that the best remedy would be to prevent the non-process compounds to enter the fiber line, i.e. to remove them prior to the cooking stage, which is closely connected to the mill's water cycle.

According to a technology called prehydrolysis kraft cooking, an acidic hydrolysis is carried out before delignification by kraft cooking (Rydholm, S. E., "Pulping Processes", Interscience, New York 1968, pp. 649 to 672; U.S. Pat. No. 5,589,033, Tikka). The objective of these processes is to remove as much hemicelluloses as possible from the cellulose macromolecule, which task the alkaline kraft cooking process can not accomplish. This is done in order to prepare pulp for products based on chemically modified cellulose such as viscose and cellulose acetate and other derivatives, which can not be manufactured in the presence of hemicelluloses. Although the prehydrolysis accomplishes a major cleaning effect, the resulting pulp has very low yield and is not suitable for papermaking purposes due to damaged fiber strength and the absence of hemicelluloses needed for fiber to fiber bonding in the paper web.

It has also been proposed to manufacture paper pulp after prehydrolysis for producing sugars to be used in fermentation to alcohols (U.S. Pat. No. 4,436,586, Elmore). According to this method, however, prehydrolysis conditions are strongly acidic and major pulp yield loss occurs due to the produced sugars. Unless used for sugar production this method cannot be an economical alternative for paper pulp production. It is also questionable, how well the paper technical properties can be maintained after such a loss of fiber bonding polysaccharides.

To remove the metals prior to alkaline cooking, chelation has been proposed (U.S. Pat. No. 5,593,544). This requires the use of chelating agents increasing the operational cost and introducing another group of organic compounds to be removed with the metals. In addition, chelation does not affect the polysaccharide side-groups hydrolytically as the pH is almost neutral, above 5.

SUMMARY OF THE INVENTION

One object of the present invention is to provide an improved alkaline delignification process for the preparation of pulp to be bleached for paper making, to be carried out within the framework of a modem closed-cycle pulp mill to meet present requirements for pulp purity after the cooking stage. In accordance with the present invention, these and other objectives have now been accomplished by means of a process for the production of pulp from lignin-containing cellulosic material, said process comprising an acidic pre-cleaning stage for the removal of metals and side groups of polysaccharides, changing the process conditions of the cleaned lignocellulosic material from cleaning to alkaline delignification, and delignifying the precleaned lignocellulosic material with alkaline cooking liquor, yielding pulp suitable for bleaching to paper pulp. For the desired cleaning of the lignocellulosic material while retaining good pulp yield and paper-technical properties it is essential to adjust the acidic conditions to arrive at an only moderately acidic end-pH level of between about 2.5–5. A lower end-pH leads to the start of polysaccharide hydrolysis, resulting in severe yield losses and adverse changes in the paper-technical properties.

According to a preferred embodiment, the conditions for the precleaning are accomplished by steaming the lignocellulosic material in order to reach a desired temperature, preferably 100–140° C., during a time sufficient for reaching an end-pH of about 2.5–5, preferably 3–4.

According to a second preferred embodiment, the conditions for the precleaning are accomplished by re-using steam on the lignocellulosic material in order to reach a desired temperature, preferably 100–140° C., during a time sufficient for reaching an end-pH of about 2.5–5, preferably 3–4.

According to a third preferred embodiment, the conditions for the precleaning are accomplished by using water or, for example, clean condensate and reacting at a temperature between 40–150° C. during a time sufficient for reaching an end-pH of 2.5–5, preferably 3–4.

According to a fourth preferred embodiment, the conditions for the precleaning are accomplished by using re-used precleaning liquid reacting at a temperature between 40–150° C. for a time sufficient for reaching an end-pH of about 2.5–5, preferably 3–4.

According to a fifth preferred embodiment, the conditions for the precleaning are accomplished by using re-used precleaning liquid and adding an acidic chemical, then reacting at a temperature between 40–150° C. for a time sufficient for reaching an end-pH of about 2.5–5, preferably 3–4.

According to a sixth preferred embodiment, the conditions for the precleaning are accomplished by using an acidic process liquid such as acidic bleaching filtrate or acidic condensate or wood room effluent, then reacting at temperature between 40–150° C. a time sufficient for reaching an end-pH of about 2.5–5, preferably 3–4.

According to a seventh preferred embodiment, the transition from precleaning to alkaline delignification is carried out by introducing an alkaline process liquid and removing the portion of the resulting transition liquor that has a pH lower than 10. In this context, "alkaline process liquid" means any available alkaline liquor, e.g white liquor, green liquor, spent alkaline cooking liquor or alkaline bleach plant filtrate.

According to an eighth preferred embodiment, the transition from the precleaning to alkaline delignification is carried out by introducing a washing liquid and subsequently removing the washing liquid by introducing the alkaline process liquid. In this context, washing liquid means any available aqueous medium, e.g water, condensate, or bleach plant filtrate.

In processes according to the invention, the lignocellulosic material is pre-cleaned prior to delignification in a more or less closed-cycle pulping process. In practice, metals and polysaccharide side groups attached to the fiber structures are transferred into the liquid medium surrounding the lignocellulosic material. Having been removed, these non-process compounds can be excluded from the process. Acidic or neutralized liquor from the transition stage before delignification can be conducted to the plant's recovery facilities, where organic compounds will be combusted and metals will be removed as dregs and muds separated as white and green liquors are filtered before returned to the pulping process. In the pre-cleaning stage, metal ions are exchanged to protons; later, following the transition stage, the protons will be replaced by sodium which is the natural cation in the process. The amount of washing in the transition stage and the fate of the leaving liquors depend on the pulp mill in question and its liquor handling capacity. It is important to note that the different embodiments enable use of the present invention in a wide variety of situations, ranging from plants with overloaded evaporation/recovery facilities where only steam condensate and some neutralized alkaline liquor make up the removed volume, up to new plants which can be designed to handle larger washing liquid volumes in the transition stage. If process internal waste waters such as bleach plant filtrates and woodhandlling effluents are used, their treatment is simultaneously made more efficient.

The invention is applicable t o alkaline pulping processes as defined above, including processes operating batchwise or continuously. Batch processes include conventional as well as those employing the displacement method well known to those skilled in the art.

BRIEF DESCRIPTION OF THE DRAWINGS

The following detailed description of the invention can be more readily understood by reference to the enclosed drawings.

DESCRIPTION OF THE PREFERRED EMBODIMENTS

In accordance with the present invention, improvements in the alkaline cooking process have now been provided by means of a process, which comprises an acidic cleaning stage before alkaline delignification. Suitable pre-cleaning agents include, for example, water in the form of steam or liquid, aqueous solutions of acids; these include organic acids, such as acetic acid, or mineral acids, such as sulfuric acid, sulfur dioxide and acid bisulfite cooking liquor; various aqueous solutions including evaporation condensates, bleach plant filtrates or wood handling effluents. In FIGS. 1–4, the cooking steps, the liquor transfer sequences, and the tanks for liquors are set forth.

Figure 1:
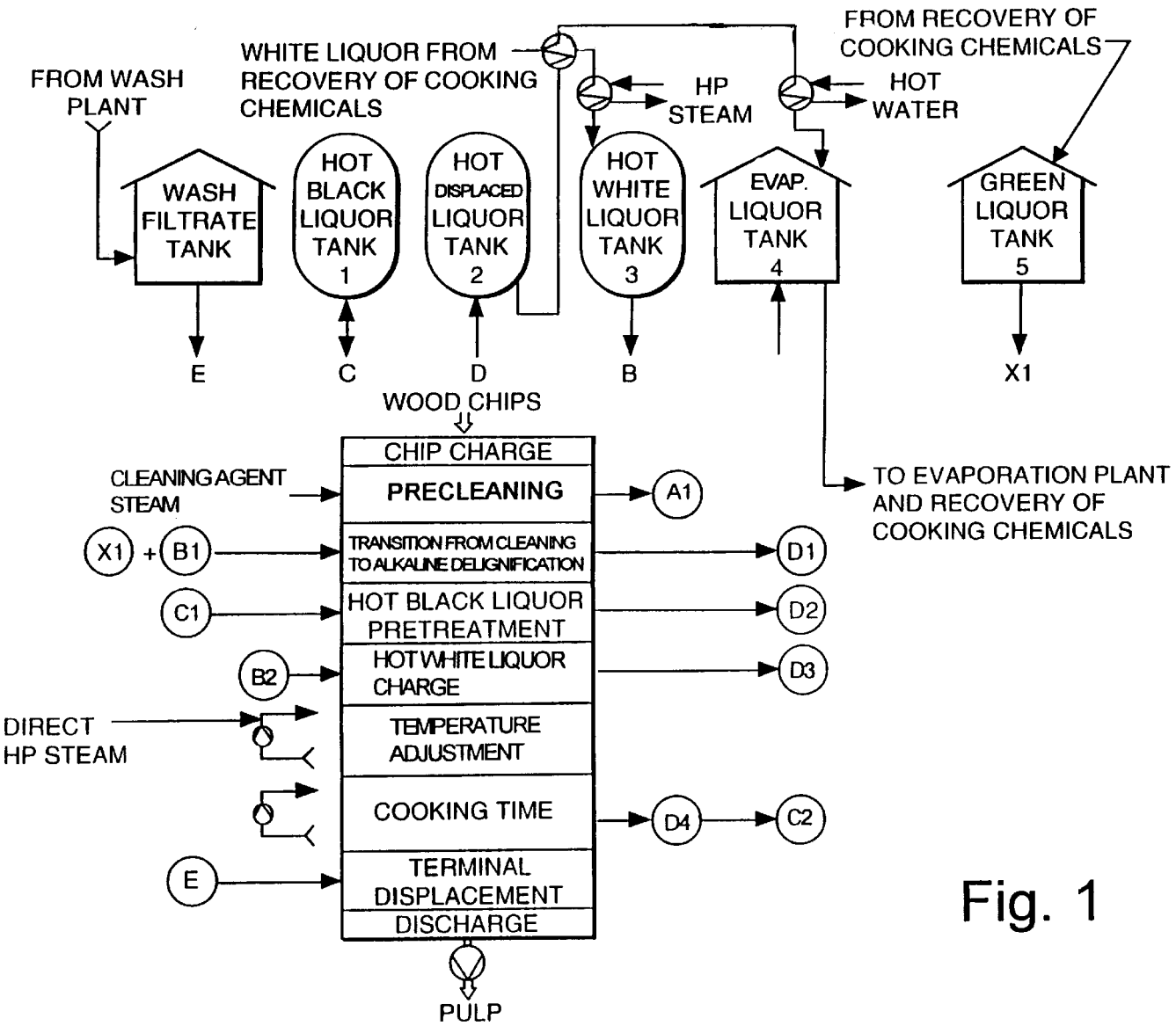
FIGS. 1–4 are schematic representations of tanks and liquor transfer sequences, illustrating embodiments of a process in accordance with the present invention.

In accordance with one embodiment of the process of the present invention shown in FIG. 1, steam is introduced to the chip-filled digester to accomplish the desired final pH between about 2.5 to 5, preferably from 3 to 4. A suitable precleaning temperature is from about 100° C. to 150° C. for both softwoods and hardwoods. In the precleaning stage, the non-process elements described above dissolve into the condensing cleaning medium and are thus removed from the wood matrix. In addition, the acidic precleaning stage dissolves disadvantageous side-groups of the polysaccharides. Simultaneously, gases, such as air and turpentine, are removed from the lignocellulosic material and vented from the digester at point A1, whereby turpentine is easily recovered. If desired, part of the cleaning agent can be removed from the digester as free liquid at point A1, before the transition stage.

After the flow of steam is interrupted, fresh hot white liquor B1 from tank 3 or uncausticized cooking liquor (green liquor) or a derivative X1 thereof from tank 5 is added to the digester to displace the cleaning medium surrounding the chips. The displaced cleaning medium leaves the digester at point D1 (transferred to tank 2). As the acid cleaning medium is displaced, the contents of the digester are neutralized. A suitable temperature of the displacing transition liquor is from about 70° C. to 150° C., preferably from about 80° C. to 140° C. The primary purpose of this transition stage is to remove the cleaning medium with the material dissolved therein, and to neutralize the cleaning medium remaining trapped within the chips. In the transition stage, the contents of the digester are prepared for later alkaline delignification. Neutralisation is achieved by selecting an appropriate neutralising alkali charge which results in slightly alkaline conditions. The pH after completion of the neutralizing transition stage is preferable over 10. This levels out fluctuation in terms of improper alkali charge and pulp quality due to fluctuating alkali charge.

During the transition stage, dissolved non-process compounds, such as Mn, Fe, Cu and Ca, which were dissolved in the acidic cleaning stage, are removed from the digester, thus lowering the content of disadvantageous non-process compounds in the final cooked pulp. This facilitates oxidative delignification and bleaching stages utilizing oxygen, peroxide, peracetic acid and ozone. In addition, side-groups of polysaccharides, such as acetyl groups, are removed from the digester before the alkaline cooking phase where the presence of these compounds would require extra alkali. Thus, the pulp is further purified from disadvantageous polysaccharide side groups, which leads to lower bleaching chemical consumption and higher pulp quality.

After the transition stage is completed, the alkaline delignification is started by pumping hot black liquor C1 from tank 1 to the digester. The black liquor begins to displace the transition liquor from the digester at D2. The displaced transition liquor flows to the hot displaced liquor tank 2. In addition, the hot black liquor flow from tank 1 causes the entire contents of the digester to be submerged in the hot black liquor and the temperature of the digester to come close to the temperature of the hot black liquor which in turn is close to the cooking temperature.

The cooking sequence is continued by pumping hot white liquor B2 from tank 3 into the digester. The liquor D3 displaced by the hot liquors is conducted to tank 2. After the filling procedure described above, the digester temperature is close to cooking temperature, typically in the range of 150–180° C. The final temperature adjustment is carried out by using direct or indirect steam heating and digester recirculation. After the cook has proceeded to the desired cooking reaction degree, the spent liquor is ready to be displaced with wash filtrate E. In the final displacement, the first portion C2 of the displaced hot black liquor corresponds to the total of the volumes of C1 required in the filling stages. The second portion of the D4 of the displaced black liquor, which is diluted by the wash filtrate E but still above its atmospheric boiling temperature, is conducted to hot displaced liquor tank 2, point D. After completed final displacement, the digester contents are discharged for further processing of the pulp. The above cooking sequence may then be repeated.

The hot black liquor tank 2 provides cooled evaporation liquor to tank 4, transferring its heat to white liquor and water by means of heat exchange. Thus, the displaced cleaning medium is sent to evaporation through tank 2 and 4. The use of steam as a cleaning agent will, however, not essentially increase the load on the evaporation function within the plant. Thus, this embodiment of the process will be easily applicable for older pulp mills with overloaded evaporation plants.

Figure 2:
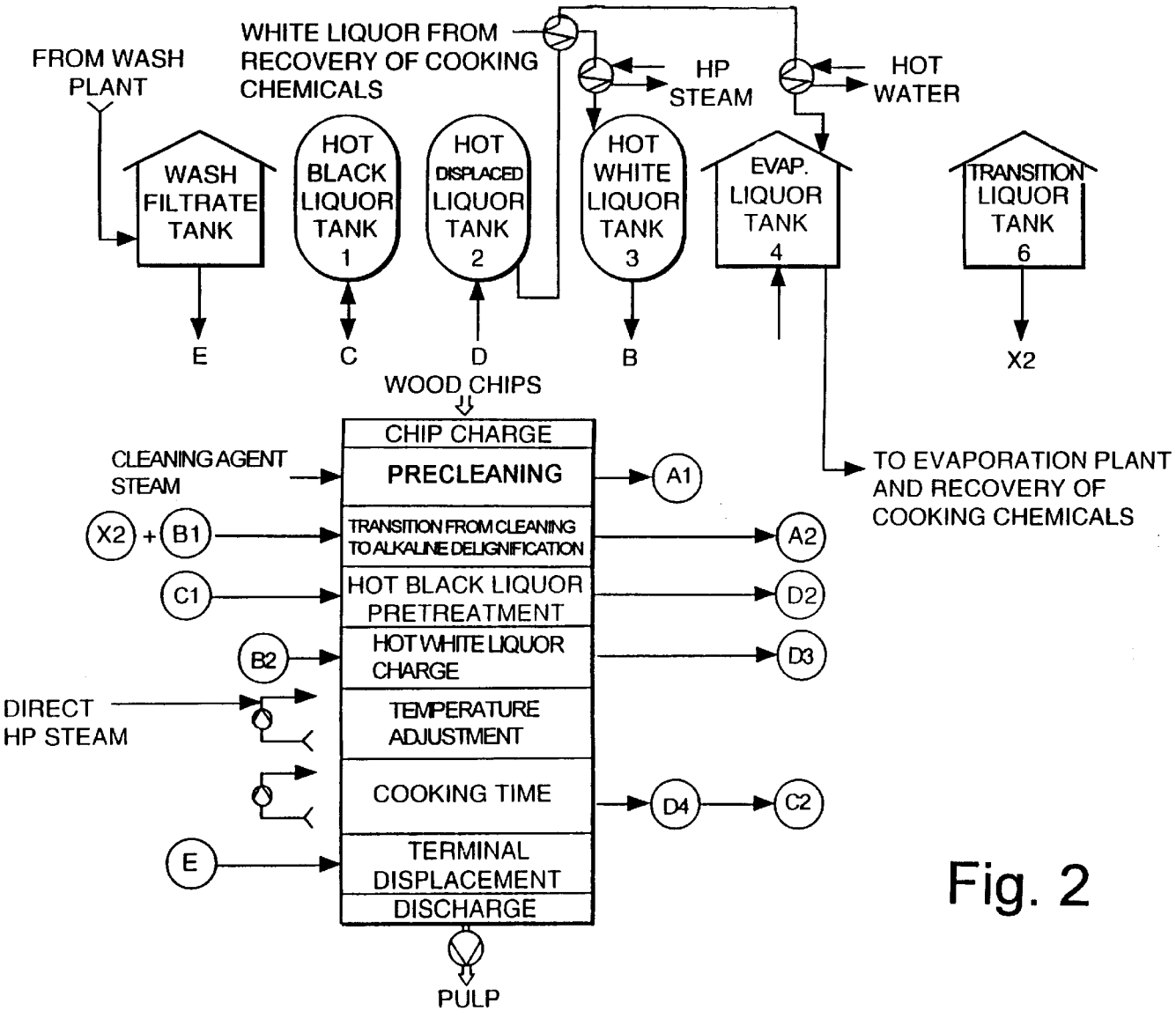

In accordance with a second embodiment of the process of the present invention shown in FIG. 2, the cleaning stage is accomplished as described above. After interruption of the flow of steam, an aqueous medium such as water, evaporation condensates or alkaline bleach plant filtrates, is added at point X2 from tank 6 to the digester to wash the chips and remove the cleaning medium from the reactor, point A2. The primary purpose of this transition stage is to remove the cleaning medium with the material dissolved therein, and to neutralize the cleaning medium remaining trapped within the chips. In the transition stage, the contents of the digester are prepared for later alkaline delignification by washing out the acidic cleaning medium with aqueous solutions. This levels out fluctuation in terms of improper alkali charge and pulp quality due to flucuating alkali charge. Liquors A1 and A2 can be reused and be stored in tank 6. The transition liquor tank 6 is provided for storage of aquous media, such as water, evaporation condensates, bleach plant filtrates or wood room effluents, supplied, point G, from other pulp mill processes. The cooking process is completed as described in connection with FIG. 1.

Figure 3:
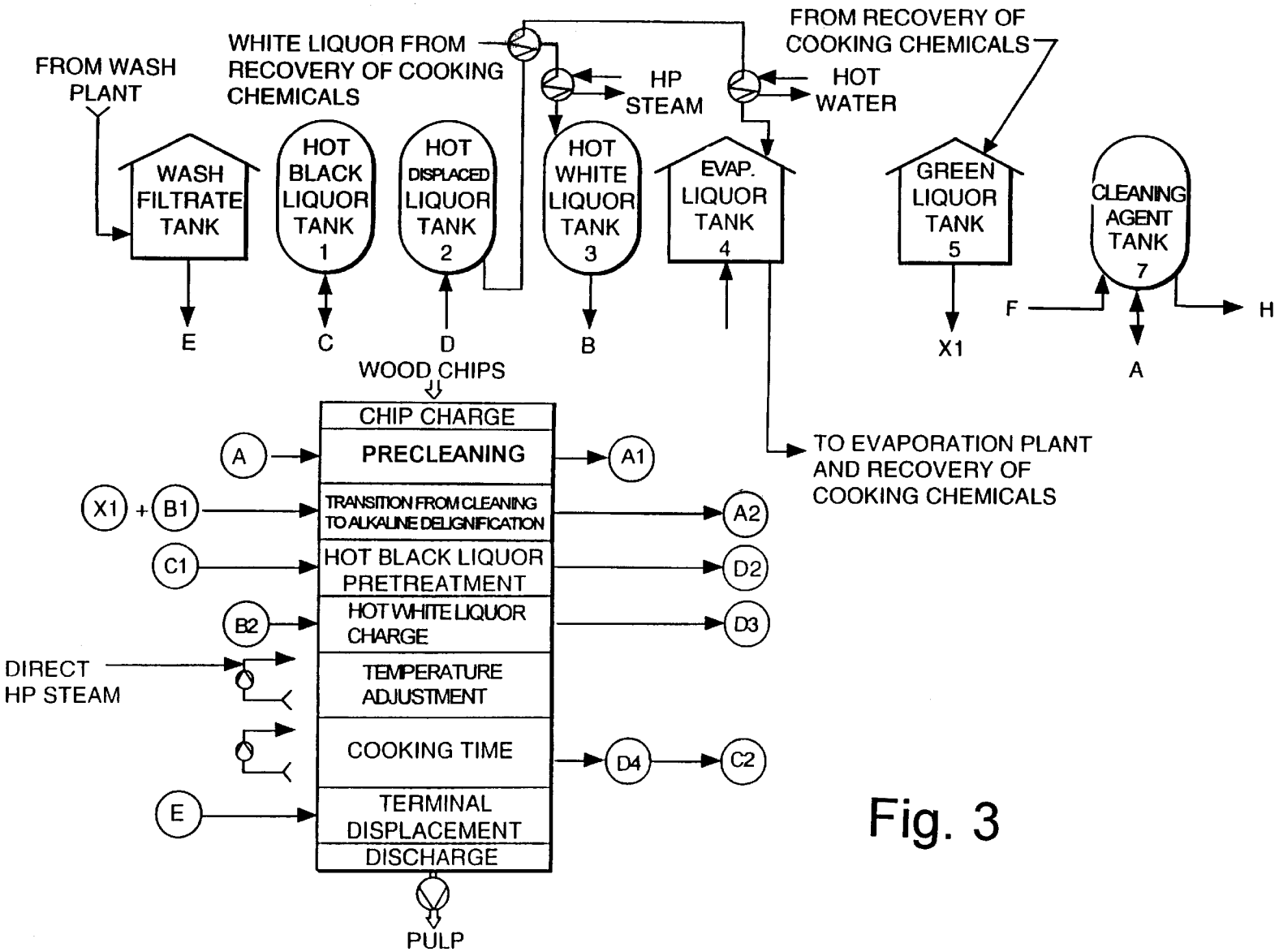

In accordance with a third embodiment of the process of the present invention shown in FIG. 3, the cleaning stage is accomplished by adding aqueous medium A and/or steam from tank 7 to achieve the end-pH after precleaning from 2.5 to 5. Suitable precleaning agents include water, aqueous solutions of acids, including organic acids such as acetic acid, and mineral acids such as sulfuric acid, sulfur dioxide and acid bisulfite cooking liquor, aqueous solutions such as evaporation condensates, bleach plant filtrates, wood handling effluents and reused cleaning agent. The precleaning agent A is added to the digester from the cleaning agent tank 7, soaking the chips. The temperature in the cleaning stage is adjusted by circulating the liquor in the digester. The temperature adjustment can be carried out by using direct or indirect steam heating in the digester recirculation. A suitable precleaning temperature is from about 40° C. to 150° C.

A suitable precleaning time is from about 10 to 200 minutes, preferably from about 20 to 120 minutes. Before the transition stage, part of the precleaning medium is recovered from the digester at point A1 to tank 7. In the transition stage, fresh hot white liquor B1 from tank 3 or uncausticized cooking liquor (green liquor) or a derivative X1 thereof is added from tank 5 to the digester. The cleaning medium surrounding the chips is displaced and leaves the digester at point A2, to be recovered to tank 7 for reuse Thus, the cleaning medium is removed from the reactor and the reactor contents are neutralized. The first part of displaced liquor which is clearly acidic, A2, is led to tank 7 whereafter the remainder of the liquor is recovered to tank 2. Neutralisation is achieved by selecting an appropriate neutralising alkali charge which results in slightly alkaline conditions.

The cleaning agent tank 7 is provided for storage of aqueous media, such as water, evaporation condensates, bleach plant filtrates or wood room effluents, supplied at point F. Suitable amounts of the acidic liquor containing dissolved organic solid is sent (point H) to either external or internal effluent treatment.

The cooking process is completed as described in connection with FIG. 1.

Figure 4:
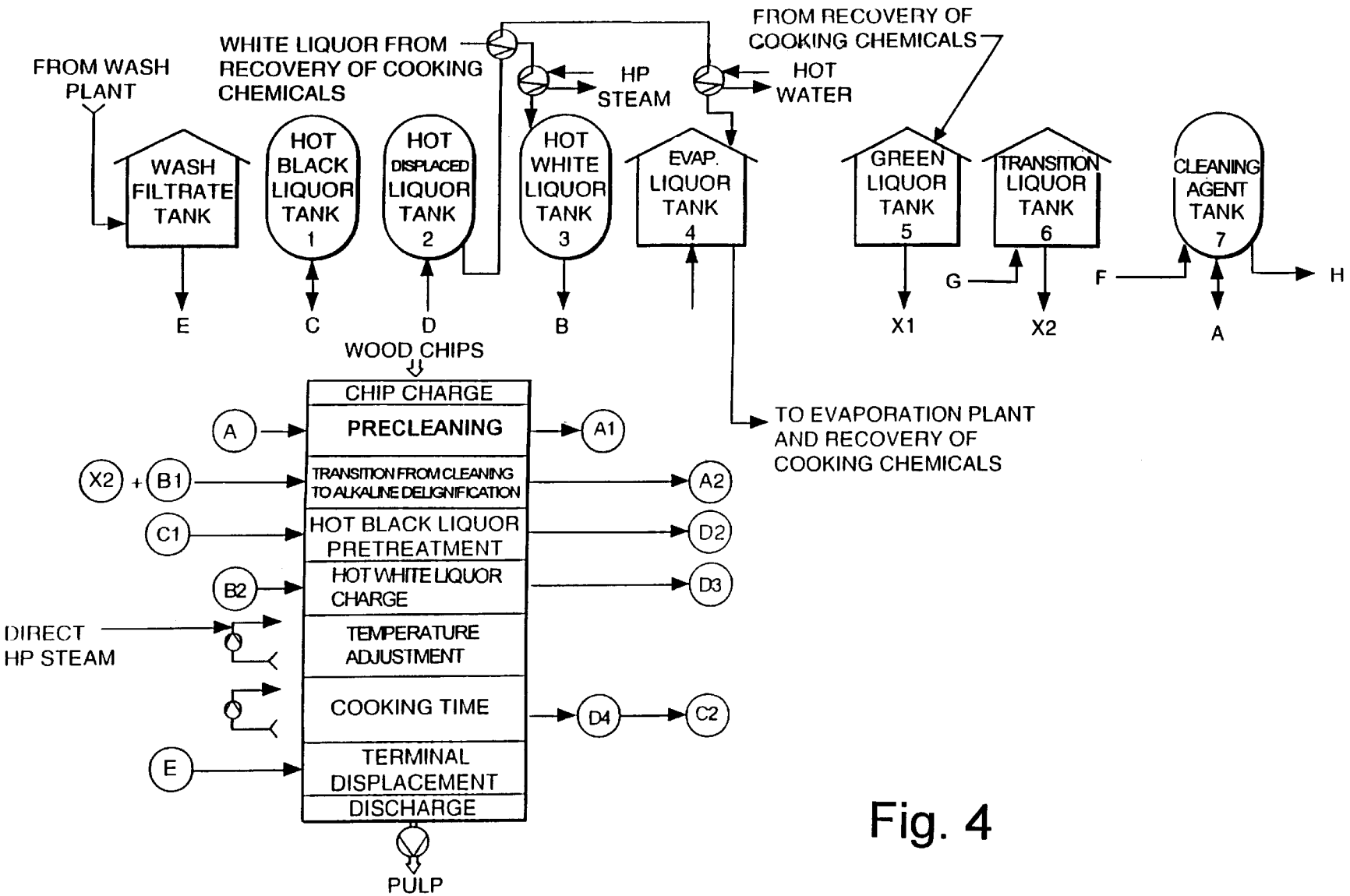

In accordance with a fourth embodiment of the process of the present invention shown in FIG. 4, the cleaning stage is accomplished by adding aqueous medium A and/or steam from tank 7 to achieve the end-pH after precleaning from 2.5 to 5. Suitable precleaning agents include water, aqueous solutions of acids, these including organic acids such as acetic acid, or mineral acids such as sulfuric acid, sulfur dioxide and acid bisulfite cooking liquor, various aqueous solutions such as evaporation condensates, bleach plant filtrates, wood handling effluents and reused cleaning agent. The precleaning agent A is added to the digester from the cleaning agent tank 7, soaking the chips. The temperature in the cleaning stage is adjusted by circulating the liquor in the digester, and the temperature adjustment can be carried out by using direct or indirect steam heating in the digester recirculation. A suitable precleaning temperature is from about 40° C. to 150° C. A suitable precleaning time is from about 10 to 200 minutes, preferably from about 20 to 120 minutes. Before the transition stage, part of the precleaning medium is recovered from the digester at point A1 to tank 7. The transition stage is carried out by adding, at point X2, an aqueous medium such as water, evaporation condensates, or bleach plant filtrates, from tank 6 to the digester to displace, at point A2, the cleaning medium surrounding the chips. The primary purpose of this transition stage is to wash out and remove the acidic cleaning medium from the reactor and to prepare for later delignification to be carried out by alkaline cooking. If desired, liquors A1 and A2 can be reused and be stored in tank 6. The transition liquor tank 6 is provided for storage of aquous media, such as water, evaporation condensates, bleach plant filtrates or wood room effluents, supplied, point G, from other pulp mill processes. The cleaning agent tank 7 is provided for storage of aquous media, such as water, evaporation condensates, bleach plant filtrates or wood room effluents, supplied at point F from other pulp mill processes. The acidic liquor F containing dissolved organic solid is sent to either external or internal effluent treatment. The cooking process is completed as described in connection with FIG. 1.

In accordance with another embodiment of the process of the present invention, the cleaning stage is carried out in a separate process unit outside the digester prior to introduction of the precleaned chips to the digester.

EXAMPLES

The following examples are illustrative of the invention and make clear the advantage over the prior art.

The following abbreviations are used in the examples:

| | |
|---|---|
| EA | Effective alkali = NaOH + ½ $Na_2S$, expressed as NaOH equivalents |
| IBL | Impregnation black liquor |
| OIBL | Over flown IBL |
| DIBL | Displaced (out) IBL |
| HBL | Hot black liquor |
| RHBL | Displaced (out) HBL |
| WL | White liquor |
| HWL | Hot white liquor |
| NWL | Neutralization white liquor |
| DNWL | Displaced (out) NWL |
| O | Oxygen delignification step |
| P | Peroxide bleaching step |

Example 1

Production of a Normal "Reference" Softwood Kraft Pulp by Using the Displacement Kraft Batch Technique.

4.0 kg softwood mix (70% pine, *Pinus sylvestris* and 30% spruce, *Picea abies*) chips (oven dry basis) were metered into a chip basket positioned in a 25-liter jacketed displacement batch digester with forced circulation. The cover of the digester was closed. Impregnation black liquor (IBL, 80–90° C., 8 g EA(NaOH)/l) was pumped during 15 minutes with some overflow (OIBL) followed by impregnation at 80° C. under 5 bar pressure for 15 minutes. After impregnation, a hot black liquor pre-treatment stage followed by introducing hot black liquor (HBL, 155° C., 24 g EA(NaOH)/l) to the bottom of the digester displacing the spent impregnation black liquor out from the top of the digester (DIBL). After the 20 min hot black liquor stage, hot white liquor (103 g EA (NaOH)/l; Sulfidity 40%) charge was introduced to the bottom of the digester displacing the corresponding volume of spent hot black liquor out of the digester top (RHBL). A 20 minutes heating-up with circulation raised the temperature from 155° C. to the cooking temperature of 170° C. After the desired cooking time fulfilled the target H-factor, the digester was cooled by introducing washing liquor (80° C., 50 liters) into the digester bottom displacing the spent black liquors out of the digester top. After the delignification, the pulp was disintegrated, washed with deionized water, screened and analyzed. The cooking conditions were adjusted to achieve kappa number 20 and residual EA at the end of the cooking stage 20 g (NaOH)/l. Mill black liquors (IBL and HBL) were used. Table E1.1. below lists the liquor inputs and outputs (volumes in liters) and the conditions in corresponding cooking stages. The unbleached pulp was analyzed in terms of screened yield, kappa number, viscosity, brightness, content of non-process compounds and pulp strength by beating and testing. White liquor charge at a constant load of alkali (EA 4.4 g (NaOH)/l) to evaporation was calculated. In addition, unbleached pulp was bleached with the bleaching sequence O-P. Oxygen stage chemical consumption, kappa number and viscosity were determined. Bleaching chemicals demand for a given pulp brightness and bleached yield were determined. Bleaching process conditions are given in table E1.2. Cooking characteristics and bleaching results are given in Table E1.3.

TABLE E1.1

Liquor inputs and outputs and corresponding cooking stage conditions in Example 1. Volumes in liters.

| Liquor in | Liquor out | Process stage |
|---|---|---|
| IBL 21 | OIBL 2 | Black liquor impregnation 80° C., 30 min |
| HBL 13.5 | DIBL 13.5 | Hot black liquor pre-treatment 155° C., 20 min |
| HWL Charge EA 16.5% NaOH +3.6 HBL | RHBL 10 | Hot white liquor fill |

TABLE E1.2

Bleaching process conditions in all examples.

| Stage | O | P |
|---|---|---|
| Time (min) | 45 | 240 |
| Temperature (° C.) | 95 | 90 |
| Consistency (%) | 10 | 8 |
| Pressure (bar) | 6 ($O_2$) | atm |
| NaOH (%) | 1.9 | varied |
| $MgSO_4$ (%) | 0.5 | — |
| $H_2O_2$ (%) | — | varied |
| End-pH | 11.5 | 10.8–11.3 |

E1.3. Cooking characteristics and bleaching results of Example 1.

| | |
|---|---|
| Cooking | |
| White liquor charge (% EA (NaOH)) | 21.6 |
| H-factor | 1000 |
| Kappa Number | 19 |
| Cooking residual (g EA (NaOH)/l) | 19 |
| Yield (%) | 45.1 |
| SCAN viscosity (ml/g) | 1041 |
| ISO Brightness (%) | 33.5 |
| Tear index at tensile index 70 Nm/g ($mNm^2/g$) | 19.3 |
| Hexenuronic acids ($\mu$mol/g) | 24 |
| Ca in pulp (mg/kg) | 866 |
| Mg in pulp (mg/kg) | 87 |
| Mn in pulp (mg/kg) | 23 |
| Oxygen Delignification | |
| Kappa Number | 11.1 |
| SCAN viscosity (ml/g) | 898 |
| NaOH consumption/ΔKappa Number (kg/OD tons) | 1.6 |
| ΔViscosity/ΔKappa Number (ml/g) | 18 |
| Bleaching (P) | |
| Peroxide consumption (kg/OD tons) | 54 |
| ISO Brightness (%) | 69 |
| Bleached Yield (%) | 43.1 |

Example 2

Production of Cleaned Kraft Pulp by Using a Batch Process.

5.0 kg softwood mix chips, as disclosed in Example 1, (oven dry basis) were metered into a chip basket positioned in a 35-liter forced circulation digester. The cover of the digester was closed and the cleaning agent (deionized water+acid) at room temperature was pumped into the digester. The amount of acid was varied to give the desired end-pH as given in Table E2.2. The digester circulation was started and heating-up (about 2° C./min) was carried out by introducing indirect pressure steam into the digester circulation. After the precleaning time had passed, the cleaning agent was drained out of the digester and washing stages with hot deionized water followed. Washing was repeated three times by repeatingly filling and draining the digester with fresh deionized water. After the washing, neutralization white liquor was pumped into the digester and the circulation was started. After the neutralization time had passed the circulation was stopped and hot black liquor (HBL), as disclosed in Example 1, was pumped into the digester bottom. The pumping first filled the digester up and then continued as displacement, ousting liquor from the top of the digester (DNWL). The hot black liquor pumping was stopped after the desired volume was pumped in. The digester circulation was started again, and the desired temperature was reached. After the hot black liquor treatment time had passed the circulation was stopped and a defined amount spent hot black liquor was drained out of the digester (RHBL). Then cooking white liquor charge was pumped into the digester bottom. After the white liquor charge the digester circulation was started and the digester heated to the desired cooking temperature, 170° C. After the desired cooking time had passed, the cooking liquor was rapidly cooled and the spent liquor discharged. The pulp was washed in the digester with hot deionized water and then discharged from the cooking basket. The pulp was disintegrated, washed with deionized water, screened and analyzed. The accept fraction was analyzed in terms of screened yield, kappa number, viscosity, brightness and content of non-process compounds. White liquor charge at a constant load of alkali (EA 4.4. g (NaOH)/l) to evaporation was calculated. The cooking conditions were adjusted to target kappa number 20 and residual EA at the end of the cooking stage 20 g (NaOH)/l. Table E2.1 lists the liquor inputs and outputs (volumes in liters) and the conditions in corresponding cooking stages. Improved cooking results with respect to reference example 1 are given in Table E2.2.

E2.1. Liquor inputs and outputs and corresponding cooking stage conditions in Example 2. Volumes in liters.

| Liquor in | Liquor out | Process stage |
|---|---|---|
| Cleaning agent 19 | — | Pre-cleaning stage, 80° C., 30 min |
| — | 17 | Drainage |
| 17 | 17 | Washing repeated three times |
| NWL Charge EA 10.4; 10.4; 14.4% NaOH | — | Neutralization, 15 min, 135° C. |
| HBL 31 | DNWL 21 | Hot black liquor pre-treatment, 20 min, 145° C. |
| HWL Charge EA 8.7% NaOH | RHBL 9 | Cooking step |

E2.2. Cooking characteristics of Example 2.

| | | | |
|---|---|---|---|
| Pre-Cleaning | | | |
| Sulfuric acid (% on wood) | | | 0.1 |
| Acetic acid (% on wood) | 0.084 | 2.0 | 21 |
| End-pH | 4.7 | 3.7 | 2.6 |
| Temperature (° C.) | 80 | 80 | 80 |
| Cooking | | | |
| White liquor charge (% EA (NaOH)) | 21.2 | 21.1 | 21.6 |
| H-factor | 1000 | 1000 | 1000 |
| Kappa Number | 21.1 | 20.0 | 18.5 |

-continued

E2.2. Cooking characteristics of Example 2.

| | | | |
|---|---|---|---|
| Cooking residual (g EA (NaOH)/l) | 19 | 20 | 20 |
| Yield (%) | 45.2 | 45.7 | 45.3 |
| SCAN viscosity (ml/g) | 1018 | 1035 | 1011 |
| ISO Brightness (%) | 31.9 | 33.5 | 34.1 |
| Ca in pulp (mg/kg) | 840 | 615 | 392 |
| Mg in pulp (mg/kg) | 72 | 36 | 32 |
| Mn in pulp (mg/kg) | 20 | 16 | 11 |

Example 3

Production of Pre-cleaned Kraft Pulp by Using a Batch Process.

The experiment was carried out as disclosed in Example 2, but with following exception. No washing stage followed the pre-cleaning stage. Neutralization white liquor (EA 10.4% NaOH) was pumped into the digester after the cleaning agent drainage. Improved results with respect to reference example 1 are given in Table E3.1.

E3.1. Cooking characteristics and bleaching results of Example 3.

| | |
|---|---|
| Pre-cleaning | |
| Acetic acid (% on wood) | 2 |
| End-pH | 3.6 |
| Temperature (° C.) | 80 |
| Cooking | |
| White liquor charge (% EA (NaOH)) | 21.2 |
| Alkali consumption (% EA (NaOH)) | 17.2 |
| H-factor | 1000 |
| Kappa Number | 20.5 |
| Cooking residual (g EA (NaOH)/l) | 19 |
| Yield (%) | 45.5 |
| SCAN viscosity (ml/g) | 1061 |
| ISO Brightness (%) | 33.4 |
| Tear index at tensile index 70 Nm/g ($mNm^2/g$) | 19.8 |
| Hexenuronic Acids ($\mu$mol/g) | 16 |
| Ca in pulp (mg/kg) | 472 |
| Mg in pulp (mg/kg) | 53 |
| Mn in pulp (mg/kg) | 16 |
| Oxygen Delignification | |
| Kappa Number | 11.9 |
| SCAN viscosity (ml/g) | 949 |
| NaOH consumption/ΔKappa Number (kg/OD tons) | 1.5 |
| ΔViscosity/ΔKappa Number (ml/g) | 13 |
| Bleaching (P) | |
| Peroxide consumption (kg/OD tons) | 32 |
| ISO Brightness (%) | 69 |
| Bleached Yield (%) | 43.6 |

Example 4

Production of Pre-cleaned Softwood Kraft Pulp by Using a Batch Process.

The experiment was carried out as disclosed in Example 3, but with following exception. Pre-cleaning temperature was 140° C. HWL Charge was EA 8.2% NaOH. Improved results with respect to reference example 1 are given in Table E4.1.

E4.1. Cooking characteristics and bleaching results of Example 4.

| | |
|---|---|
| Pre-cleaning | |
| Acetic acid (% on wood) | 2 |
| End-pH | 3.6 |
| Temperature (° C.) | 140 |
| Cooking | |
| White liquor charge (% EA (NaOH)) | 21.2 |
| H-factor | 1000 |
| Kappa Number | 19.1 |
| Cooking residual (g EA (NaOH)/l) | 19 |
| Yield (%) | 43.5 |
| SCAN viscosity (ml/g) | 1039 |
| ISO Brightness (%) | 33.5 |
| Tear index at tensile index 70 Nm/g ($mNm^2/g$) | 22.5 |
| Hexenuronic Acids ($\mu$mol/g) | 13 |
| Ca in pulp (mg/kg) | 542 |
| Mg in pulp (mg/kg) | 38 |
| Mn in pulp (mg/kg) | 14 |
| Oxygen Delignification | |
| Kappa Number | 10.5 |
| SCAN viscosity (ml/g) | 953 |
| NaOH consumption/ΔKappa Number (kg/OD tons) | 1.45 |
| ΔViscosity/ΔKappa Number (ml/g) | 10 |
| Bleaching (P) | |
| Peroxide consumption (kg/OD tons) | 19 |
| ISO Brightness (%) | 69 |
| Bleached Yield (%) | 42.4 |

Example 5

Production of Pre-cleaned Softwood Kraft Pulp by Using a Batch Process.

The experiment was carried out as disclosed in Example 2, but with following exception. The cleaning agent used in this example was circulated three times in previous cooks. The cleaning agent was drained from a previous cook and used in this example with an addition of deionized water (0.5 liquor-to-wood ratio) and acetic acid. The HWL Charge was EA 9.3% NaOH. Improved cooking characteristics and bleaching results with respect to reference example 1 are given in Table E5.1.

E5.1. Cooking characteristics and bleaching results of Example 5.

| | |
|---|---|
| Pre-cleaning | |
| Acetic acid (% on wood) | 0.8 |
| End-pH | 3.5 |
| Temperature (° C.) | 80 |
| Cooking | |
| White liquor charge (% EA (NaOH)) | 21.6 |
| H-factor | 1000 |
| Kappa Number | 19.8 |
| Cooking residual (g EA (NaOH)/l) | 19 |
| Yield (%) | 45.3 |
| SCAN viscosity (ml/g) | 1014 |
| ISO Brightness (%) | 33.6 |
| Ca in pulp (mg/kg) | 420 |
| Mg in pulp (mg/kg) | 38 |
| Mn in pulp (mg/kg) | 12 |

-continued

| E5.1. Cooking characteristics and bleaching results of Example 5. | |
|---|---|
| Oxygen Delignification | |
| Kappa Number | 11.2 |
| SCAN viscosity (ml/g) | 915 |
| NaOH consumption/ΔKappa Number (kg/OD tons) | 1.45 |
| ΔViscosity/ΔKappa Number (ml/g) | 12 |
| Bleaching (P) | |
| Peroxide consumption (kg/OD tons) | 33 |
| ISO Brightness (%) | 69 |
| Bleached Yield (%) | 43.3 |

Example 6

Production of a Normal "Reference" Hardwood Kraft Pulp by Using the Displacement Kraft Batch Technique.

4.5 kg hardwood, Birch (*Betula pubescens*), chips (oven dry basis) were metered into a chip basket positioned in a 25-liter jacketed displacement batch digester with forced circulation. The cover of the digester was closed. Impregnation black liquor (IBL, 80–90° C., 14 g EA(NaOH)/l) was pumped during 15 minutes with some overflow (OIBL) followed by impregnation at 80° C. under 5 bar pressure for 15 minutes. After impregnation, a hot black liquor pre-treatment stage followed by introducing hot black liquor (HBL, 145° C., 13 g EA(NaOH)/l) to the bottom of the digester displacing the spent impregnation black liquor out from the top of the digester (DIBL). After the 20 min hot black liquor stage, hot white liquor (103 g EA(NaOH)/l; Sulfidity 40%) charge was introduced to the bottom of the digester displacing the corresponding volume of spent hot black liquor out of the digester top (RHBL). A 10 minutes heating-up with circulation raised the temperature from 145° C. to the cooking temperature of 160° C. After the desired cooking time fulfilled the target H-factor, the digester was cooled by introducing washing liquor (80° C., 50 liters) into the digester bottom displacing the spent black liquors out of the digester top. After the delignification, the pulp was disintegrated, washed with deionized water, screened and analyzed.

The cooking conditions were adjusted to achieve kappa number 17 and residual EA at the end of the cooking stage 14 g (NaOH)/l. Mill black liquors (IBL and HBL) were used. The Table E6.1. below lists the liquor inputs and outputs (volumes in liters) and the conditions in corresponding cooking stages. The unbleached pulp was analyzed in terms of screened 5 yield, kappa number, viscosity, brightness, content of non-process compounds. White liquor charge at a constant load of alkali to evaporation was calculated. Cooking results are given in Table E6.2.

TABLE E6.1

Liquor inputs and outputs and corresponding cooking stage conditions in Example 6. Volumes in liters.

| Liquor in | Liquor out | Process stage |
|---|---|---|
| IBL 20 | OIBL 1 | Black liquor impregnation 80° C., 30 min |
| HBL 12 | DIBL 12 | Hot black liquor pre-treatment 145° C., 20 min |
| HWL Charge | | |

TABLE E6.1-continued

Liquor inputs and outputs and corresponding cooking stage conditions in Example 6. Volumes in liters.

| Liquor in | Liquor out | Process stage |
|---|---|---|
| EA 15% NaOH +3 HBL | RHBL 9.5 | Hot white liquor fill |

| E6.2. Results of Example 6. | |
|---|---|
| Cooking | |
| White liquor charge (% EA (NaOH)) | 19.6 |
| H-factor | 355 |
| Kappa Number | 17 |
| Cooking residual (g EA (NaOH)/l) | 14 |
| Yield (%) | 51.4 |
| SCAN viscosity (ml/g) | 1291 |
| ISO Brightness (%) | 37 |
| Ca in pulp (mg/kg) | 554 |
| Mg in pulp (mg/kg) | 89 |
| Mn in pulp (mg/kg) | 25 |

Example 7

Production of Pre-cleaned Hardwood Kraft Pulp by Using a Batch Process.

5.0 kg hardwood chips, as disclosed in Example 6, (oven dry basis) were metered into a chip basket positioned in a 35-liter forced circulation digester. The cover of the digester was closed and the cleaning agent (deionized water+acid) at room temperature was pumped into the digester. The amount of acid was varied to give the desired end-pH as given in Table E7.2. The digester circulation was started and heating-up (about 2° C./min) was carried out by introducing indirect pressure steam into the digester circulation. After the pre-cleaning time had passed, the cleaning agent was drained out of the digester and washing stages with hot deionized water followed. Washing was repeated three times by repeatingly filling and draining the digester with fresh deionized water. After the washing, neutralization white liquor was pumped into the digester and the circulation was started. After the neutralization time had passed the circulation was stopped and hot black liquor (HBL), as disclosed in Example 6, was pumped into the digester bottom. The pumping first filled the digester up and then continued as displacement, ousting liquor from the top of the digester (DNWL). The hot black liquor pumping was stopped after the desired volume was pumped in. The digester circulation was started again, and the desired temperature was reached. After the hot black liquor treatment time had passed the circulation was stopped and a certain amount spent hot black liquor was drained out of the digester (RHBL). Then cooking white liquor charge was pumped into the digester bottom. After the white liquor charge the digester circulation was started and the digester heated to the desired cooking temperature, 160° C. After the desired cooking time had passed, the cooking liquor was rapidly cooled and the spent liquor discharged. The pulp was washed in the digester with hot deionized water and then discharged from the cooking basket. The pulp was disintegrated, washed with deionized water, screened and analyzed. The accept fraction was analyzed in terms of screened yield, kappa number, viscosity, brightness and content of non-process compounds. Normalised white liquor charge at a constant charge of alkali to evaporation was calculated. The cooking conditions were adjusted to target kappa number 17 and residual EA at the end of the cooking stage 14 g (NaOH)/l. Table E7.1 lists the liquor inputs and outputs (volumes in liters) and the conditions in corresponding cooking stages. Improved cooking characteristics with respect to reference example 6 are given in Table E7.2.

E7.1. Liquor inputs and outputs and corresponding cooking stage conditions in Example 7. Volumes in liters.

| Liquor in | Liquor out | Process stage |
|---|---|---|
| Cleaning agent 22 | — | Cleaning stage, 80° C., 30 min |
| — | 19 | Drainage |
| 19 | 19 | Washing repeated three times |
| NWL Charge EA 12.3% NaOH | — | Neutralization, 15 min, 135° C. |
| HBL 30 | DNWL 21 | Hot black liquor pre-treatment, 20 min, 140° C. |
| HWL Charge EA 8.3% NaOH | RHBL 9 | Cooking step |

E7.2. Cooking results of Example 7.

| | |
|---|---|
| Pre-cleaning | |
| Acetic acid (% on wood) | 0.7 |
| End-pH | 4.0 |
| Temperature (° C.) | 80 |
| Cooking | |
| White liquor charge (% EA (NaOH)) | 19.7 |
| H-factor | 360 |
| Kappa Number | 18 |
| Cooking residual (g EA (NaOH)/l) | 13 |
| Yield (%) | 52.2 |
| SCAN viscosity (ml/g) | 1358 |
| ISO Brightness (%) | 35 |
| Ca in pulp (mg/kg) | 392 |
| Mg in pulp (mg/kg) | 41 |
| Mn in pulp (mg/kg) | 11 |

Example 8

Production of Pre-cleaned Hardwood Kraft Pulp by Using a Batch Process.

The experiment was carried out as disclosed in Example 7, but with following exception. Pre-cleaning temperature was 140° C. No washing stage with water followed the pre-cleaning stage. The HWL charge was EA 8.7% NaOH. Improved cooking characteristics in respect to reference example 6 are given in Table E8.1.

E8.1. Results of example 8.

| | |
|---|---|
| Pre-cleaning | |
| Acetic acid (% on wood) | 1.5 |
| End-pH | 3.7 |
| Temperature (° C.) | 140 |
| Cooking | |
| White liquor charge (% EA (NaOH)) | 20.6 |
| H-factor | 340 |
| Kappa Number | 17 |
| Cooking residual (g EA (NaOH)/l) | 14 |
| Yield (%) | 50.4 |
| SCAN viscosity (ml/g) | 1390 |
| ISO Brightness (%) | 38 |
| Ca in pulp (mg/kg) | 434 |
| Mg in pulp (mg/kg) | 40 |
| Mn in pulp (mg/kg) | 13 |

Example 9

Production of Normal Industrial Softwood Kraft Pulp Using a Displacement Kraft Batch Digester.

An industrial batch digester having a capacity of 400 $m^3$ was filled with 66 OD tons of softwood chips (*Pinus sylvestris* and *Picea abies*) using chip steam packing, air evacuation and impregnation black liquor (IBL, 80–90° C., 20 g EA(NaOH)/l) was pumped. After impregnation, a hot black liquor pre-treatment stage followed by introducing hot black liquor (HBL, 15 g EA(NaOH)/l) to the bottom of the digester displacing the spent impregnation black liquor out from the top of the digester. After the hot black liquor stage, hot white liquor charge (HWL, 69 m3, 125 g EA(NaOH)/l, sulfidity 35%) was introduced to the bottom of the digester displacing the corresponding volume of spent hot black liquor out of the digester top. A heating-up with circulation raised the temperature to the cooking temperature of 169° C. A white liquor charge (HWL, 20 m3, 125 g EA (NaOH)/l, sulfidity 35%) at H-factor 400 was introduced to the digester displacing the corresponding amount of spent black liquor. After the desired cooking time fulfilled the target H-factor, the digester was cooled by introducing washing liquor (DPL, 9 g NaOH/l) into the digester bottom displacing the spent black liquors out of the digester top to two pressurized hot black liquor tanks. After the displacement, the digester was discharged, pulp was sampled, washed, screened and analyzed. The digestion and pulp sampling was carried out three times using constant mill conditions. The unbleached pulp was analyzed in terms of kappa number, content of non-process compounds, laboratory bleaching, pulp strength by beating and testing analysis. The content of calcium in the evaporation black liquor was analyzed by filtering the evaporation black liquor through a 0.2 mm filter. The filter separates among others calcium crystals and the calcium analysis of the filtered sample indicates the amount of soluble calcium complexes which can break down and form calcium scaling in down-stream processes if reaching critical scaling conditions as e.g. temperature and dry solid near heat exchanger surfaces. Laboratory bleaching process conditions are given in table E9.1. Cooking characteristics and bleaching results are given in table E9.2.

TABLE E9.1

Bleaching process conditions in all examples.

| Stage | O | D | EOP | D | n | D |
|---|---|---|---|---|---|---|
| Time (min) | 60 | 60 | 120 | 180 | 5 | 180 |
| Temperature (° C.) | 105 | 55 | 80 | varied | varied | varied |
| Consistency (%) | 12 | 10 | 12 | 12 | 8 | 12 |
| Pressure (bar) | 6 ($O_2$) | | 2 (O2) | | | |
| NaOH (%) | 1.5 | | 1.5 | | 0.5 | |
| $MgSO_4$ (%) | 0.25 | | 0.2 | | | |
| $H_2O_2$ (%) | — | | 0.3 | | | |
| Active Chlorine (%) | | 1.9—2.0 | | 0.4–2.4 | | 0.2–1.2 |
| End-pH | 10.2 | 2.2 | 12 | 2.5–3 | | 3.8–4.4 |

E9.2. Cooking characteristics and bleaching results

| | |
|---|---|
| Cooking | |
| Alkali consumption (% EA (NaOH)) | 17.5 |
| H-factor | 1180 |
| Kappa Number | 22.8 |
| Cooking residual (g EA (NaOH)/l) | 17 |
| Tear index at tensile index 70 Nm/g ($mNm^2/g$) | 16.1 |
| Ca in pulp (mg/kg) | 997 |
| Mn in pulp (mg/kg) | 73 |
| Evaporation black liquor | |
| Ca content through filter 0.2 mm (ppm of dry solid) | 270 |
| Bleaching (O—D(EOP)DnD) | |
| Active chlorine consumption (kg/OD tons) | 37.4 |
| ISO Brightness (%) | 90.3 |
| Tear index at tensile index 70 Nm/g ($mNm^2/g$) | 18.0 |

Example 10

Production of Precleaned Kraft Pulp Using a Industrial Softwood Kraft Displacement Kraft Batch Digester.

An industrial batch digester having a capacity of 400 $m^3$ was filled with 67 OD tons of softwood chips (*Pinus sylvestris* and *Picea abies*) using chip steam packing and air evacuation, as disclosed in Example 9. A few minutes into the chip fill, medium pressure (MP) steam was charged to the bottom of the digester and undesired gases was evacuated from the digester. After chip filling, the top valve (cover) was closed and the temperature was increased to 140° C. with medium pressure steam to accomplish the desired pH range 2.5–5. The temperature in the digester was held for 15 minutes. Degassing was carried out through condensors to the turpentine recovery. After the desired time fulfilled, neutralization white liquor (NWL, 65 m3, 127 g EA (NaOH)/l, sulfidity 34%) was introduced to the bottom of the digester. After the neutralization white liquor pad was added, hot spent black liquor was introduced (HBL, 15 g EA(NaOH)/l) to the bottom of the digester displacing the steam condensate and the neutralization white liquor out from the top of the digester and the contents of the digester was neutralized after the acid steaming stage. After the hot black liquor stage, hot white liquor charge (HWL, 25 m3, 127 g EA(NaOH)/l, sulfidity 34%) was introduced to the bottom of the digester displacing the corresponding volume of spent hot black liquor out of the digester top. A heating-up with circulation and direct heating raised the temperature to the cooking temperature of 168° C. A white liquor charge (HWL, 27 m3, 127 g EA (NaOH)/l, sulfidity 34%) at H-factor 400 was introduced to the digester displacing the corresponding amount of spent black liquor. After the desired cooking time fulfilled the target H-factor, the digester was cooled by introducing washing liquor (DPL, 9 g NaOH/l) into the digester bottom displacing the spent black liquors out of the digester top to two separate hot black liquor accumulators. After the displacement, the digester was discharged, pulp was sampled, washed, screened and analyzed. The digestion was carried out four times using constant mill conditions. The evaporation black liquor was made up according to the principle shown in FIG. 1. The unbleached pulp was analyzed in terms of kappa number, content of non-process elements, laboratory bleaching, and pulp strength by beating and testing. The content of soluble calcium in the evaporation black liquor was analyzed by filtering through a 0.2 mm filter, as disclosed in example 9. Improved results with respect to reference example 9 are given in table E10.1.

E10.3. Cooking characteristics and bleaching results

| | |
|---|---|
| Cooking | |
| Alkali consumption (% EA (NaOH)) | 17.8 |
| H-factor | 1180 |
| Kappa Number | 20.3 |
| Cooking residual (g EA (NaOH)/l) | 19 |
| Tear index at tensile index 70 Nm/g ($mNm^2/g$) | 17.5 |
| Ca in pulp (mg/kg) | 983 |
| Mn in pulp (mg/kg) | 54 |
| Evaporation black liquor | |
| Ca content through filter 0.2 mm (ppm of dry solid) | 100 |
| Bleaching (O—D(EOP)DnD) | |
| Active chlorine consumption (kg/OD tons) | 37.1 |
| ISO Brightness (%) | 90.1 |
| Tear index at tensile index 70 Nm/g ($mNm^2/g$) | 19.8 |

Discussion

Today's stringent environmental regulations strive to lower the amount of effluents from the production of chemical pulp for paper-making and outlaw the use of chlorine compounds in bleaching. Therefore, the bleaching must be carried out using oxidative agents such as oxygen, hydrogen peroxide and ozone. As the mills gets more closed and the bleaching chemicals are significantly less selective, thus compromising the pulp quality more in bleaching, the quality of the unbleached pulp should be higher than before. For example, the content of non-process compounds in unbleached pulp and the load of non-process compounds on bleaching must be lowered in order to the more stringent environmental regulations to be met.

Example 1 demonstrates the results from a displacement kraft batch cook of softwood, thus showing the state-of-the-art cooking process. As can be seen, the pulp contains considerable amounts of non-process compounds, thus increasing the manufacturing costs and making mill closure more complicated.

Examples 2, 3, 4 and 5 demonstrate the results when the process is carried out on softwood according to the present invention. The amount of non-process compounds in the unbleached pulp was significantly lowered when a precleaning stages was carried out under acidic conditions prior to alkaline delignification. In addition, the unbleached and bleached yield is essentially at the same level as shown in the reference example 1. Thus, the precleaning stage according to the present invention produce pulp of well-acceptable yield. Thus, the invention overthrows the prejudice that an acidic pretreatment dissolves hemicelluloses and thus lowers yield, according to the teaching of, for example, U.S. Pat. No. 4,436,586.

A surprising benefit over the state-of-the-art cooking process is that the pulps produced according to the invention contains considerable less hexuronic acid groups.

Additional proof of the advantages provided by the present invention is the more selective oxygen delignification and better bleachability of the pulp produced. The viscosity drop per kappa reduction unit in oxygen delignification was significantly reduced when the process is carried out according to the present invention. Furthermore, more efficient delignification as measured in terms of sodium hydroxide consumption per kappa reduction in oxygen delignification was seen. In bleaching, the pulps produced according to the present invention consumed significantly less bleaching chemicals to reach a given brightness than the pulps prepared according to the prior art.

Another element of advantage is the improved strength of pulp when producing pulp according to the present invention.

Example 5 further demonstrates the results when the process is carried out according to the present invention recirculating and re-using the cleaning agent. This procedure will eventually lower the acid charge in pre-cleaning, making the process economically feasible and reducing use of highly corrosive, strong acids. If a higher pre-cleaning temperature is used, more acidity is liberated from the wood and the need for acid additions further declines. Thus, the invention overthrows the prejudice that an acidic pretreatment requires $H_2SO$, or equivalent strong acids, according to the teaching of, for example, U.S. Pat. No. 4,436,586.

Example 6 demonstrates the results from a displacement kraft batch cook of hardwood, representing a state-of-the-art cooking process. As can be seen, the pulp contains considerable amounts of non-process compounds.

Example 7 and 8 demonstrate the results when the process is carried out on hardwood according to the present invention. The amount of non-process compounds in the unbleached pulp was significantly lowered when a precleaning stage was carried out under acidic conditions prior to alkaline delignification. In addition, pulp yield was not essentially affected. Thus, these examples show that the present invention may advantageously be applied also to hardwoods.

Example 9 demonstrates the results from an industrial displacement kraft batch cook of softwood, representing state-of-art cooking process. As can be seen, the pulp contains considerable amounts of non-process compounds. In addition, the produced evaporation black liquor contains a high amount of calcium which passes a 0.2 mm filter. The evaporation black liquor analysis indicates the amount of calcium which can create calcium scaling if critical conditions as e.g. temperature are exceeded in down-stream processes e.g. near heat exchange surfaces.

Example 10 demonstrates the results when the process is carried out on an industrial displacement kraft batch digester using softwood and according to the present invention. The amount of non-process compounds in the unbleached pulp was significantly lowered when a precleaning stage was carried out by steaming to achieve liberation of wood acidity and acidic conditions inside the chips prior to alkaline kraft cooking. When higher temperature is used in steaming, more acidity is liberated which makes it possible to remove metals and side groups of polysaccharides. Improved strength of pulp was observed when producing according to the present invention. Another element of advantage was a lower content of detrimental calcium which passes through a 0.2 mm filter in the produced evaporation black liquor when producing according to the invention. Thus, this example show that the present invention may be advantageously be applied and improves down-stream processes.

What is claimed is:

1. A method for preparation of paper pulp from lignocellulosic material containing polysaccharides comprising precleaning said lignocellulosic material at a temperature of between about 40 and 150° C. under acidic conditions essentially without dissolution of said polysaccharides, said precleaning step having a final pH in the range of about 2.5 to 5, following said precleaning step, contacting said lignocellulosic material with a predetermined amount of an alkaline process liquor in order to effect the transition in said precleaning process condition to alkaline cooking process conditions, said predetermined amount of said alkaline process liquor being sufficient to neutralize said lignocellulosic material to a pH of at least about 7, subsequently removing the resulting neutralized liquor from said process and cooking said lignocellulosic material with alkaline cooking liquor thereby preparing a paper pulp high in hemicellulose content.

2. The method of claim 1 wherein said cooking comprises a batch cooking process.

3. The method of claim 2 wherein said cooking comprises a displacement batch cooking process.

4. The method of claim 1 wherein said cooking comprises a continuous cooking process.

5. The method of claim 1 wherein said precleaning step includes treating said lignocellulosic material with water or steam.

6. The method of claim 5 wherein said water or steam includes a predetermined amount of at least one acid.

7. The method of claim 1 wherein said method comprises an element of a kraft process.

8. The method of claim 1 wherein said transition step comprises a first alkaline stage following said precleaning step, and wherein said first alkaline stage has a final pH higher than about 10.

9. The method of claim 1 wherein said method comprises an element of a soda process.

10. A method for preparation of paper pulp from lignocellulosic material containing polysaccharides comprising precleaning said lignocellulosic material at a temperature of between about 40 and 150° C. under acidic conditions essentially without dissolution of said polysaccharides, said precleaning step having a final pH in the range of about 2.5 to 5, following said precleaning step, contacting said lignocellulosic material with a washing liquor in order to effect the transition in said precleaning process condition to alkaline cooking process conditions, subsequently removing the resulting liquor from said process and cooking said lignocellulosic material with alkaline cooking liquor, thereby preparing a paper pulp high in hemicellulose content.

11. The method of claim 10 wherein said adding of said washing liquor is carried out using water or evaporation condensate.

12. The method of claim 10 wherein said cooking comprises a batch cooking process.

13. The method of claim 12 wherein said cooking comprises a displacement batch cooking process.

14. The method of claim 10 wherein said cooking comprises a continuous cooking process.

15. The method of claim 10 wherein said precleaning step includes treating said lignocellulosic material with water or steam.

16. The method of claim 15 wherein said water or steam includes a predetermined amount of at least one acid.

17. The method of claim 10 wherein said method comprises an element of a kraft process.

18. The method of claim 10 wherein said method comprises an element of a soda process.

* * * * *

UNITED STATES PATENT AND TRADEMARK OFFICE

CERTIFICATE OF CORRECTION

PATENT NO. : 6,533,896 B1 
DATED : March 18, 2003
INVENTOR(S) : Panu Tikka, Mikael Svedman and Thomas Fant It is certified that error appears in the above-identified patent and that said Letters Patent is hereby corrected as shown below:

Column 4,
Line 50, “t o” should read -- to --.

Column 6,
Line 50, begin a new paragraph with the words -- The cooking process… --.

Column 7,
Line 62, begin a new paragraph with the words -- The cooking process… --.

Column 19,
Line 46, “$H_2SO$,” should read -- $H_2SO_4$ --.

Signed and Sealed this

Twenty-sixth Day of August, 2003

JAMES E. ROGAN
*Director of the United States Patent and Trademark Office*